United States Patent [19]

Boccadoro et al.

[11] Patent Number: 4,697,562

[45] Date of Patent: Oct. 6, 1987

[54] PROCESS AND DEVICE FOR REGULATING THE ROTATION SPEED IN NEUTRAL OF A CONTROLLED IGNITION ENGINE EQUIPPED WITH INTERMITTENTLY FUNCTIONING ACCESSORIES

[75] Inventors: Yves Boccadoro, Feucherolles; Philippe Shuttler, Antony, both of France

[73] Assignee: Regie Nationale des Usines Renault, Boulogne Billancourt, France

[21] Appl. No.: 939,287

[22] Filed: Dec. 4, 1986

Related U.S. Application Data

[63] Continuation of Ser. No. 583,616, Feb. 27, 1984, abandoned.

[30] Foreign Application Priority Data

Feb. 25, 1983 [FR] France ..... 83 03081

[51] Int. Cl.[4] ..... F02M 3/00

[52] U.S. Cl. ..... 123/339; 123/340

[58] Field of Search ..... 123/339, 340, 585, 352, 123/361

[56] References Cited

U.S. PATENT DOCUMENTS

| | | | |
|---|---|---|---|
| 4,297,978 | 11/1981 | Matsas | 123/339 |
| 4,344,399 | 8/1982 | Matsumura et al. | 123/339 |
| 4,354,466 | 10/1982 | Dudley et al. | 123/339 |
| 4,444,168 | 4/1984 | Matsumura et al. | 123/339 |
| 4,446,832 | 5/1984 | Matsumura et al. | 123/339 |

*Primary Examiner*—Raymond A. Nelli

*Attorney, Agent, or Firm*—Oblon, Fisher, Spivak, McClelland, & Maier

[57] ABSTRACT

According to this process, during the starting and stopping of at least one accessory device (12) that causes a sudden variation in the resisting torque, signals controlling the starting and the stopping of the accessory device (12) are detected, and the control of the accessory device (12) is temporarily delayed by said control signals. There is controlled, for a first predetermined time period ($T_1$), an increase in the airflow of the engine in response to the detection of a signal controlling the starting of the accessory device, and for a second predetermined time period ($T_3$), a decrease in the airflow in response to the detection of a signal controlling the stopping of the accessory device. The starting and the stopping respectively of the accessory device (12) are controlled approximately at the end of the predetermined periods.

3 Claims, 3 Drawing Figures

PROCESS AND DEVICE FOR REGULATING THE ROTATION SPEED IN NEUTRAL OF A CONTROLLED IGNITION ENGINE EQUIPPED WITH INTERMITTENTLY FUNCTIONING ACCESSORIES

This is a continuation of application Ser. No. 583,616, filed on Feb. 27, 1984 and now abandoned.

FIELD OF THE INVENTION

This invention relates to a process and a device for regulating the rotation speed in neutral of a controlled ignition engine, during the starting and stopping of at least one accessory device that causes a sudden variation in the resisting torque.

BACKGROUND OF THE INVENTION

In the case of motor vehicles equipped with an accessory device, such as for example an air conditioning system, one of the main difficulties is to correct, in neutral operation and mainly at idle, the drop in engine speed due to the starting of the accessory device, and the increase in engine speed due to the stopping of the accessory device.

In addition, in the case of vehicles equipped with an air conditioning system and power steering or an automatic transmission, the conjunction of the resisting torques produced, on the one hand, by the starting of the air conditioning compressor and, on the other hand, by the lock of the wheels or the engaging of the hydraulic converter can, under certain circumstances, cause the engine to stall. This problem is even more crucial for vehicles comprising all three devices.

Moreover, the fall and increase in engine speed due respectively to the starting and stopping of the accessory device or devices is physiologically unpleasant for the occupants of the vehicle.

It is already known how to regulate the average idling speed of a controlled ignition engine by referring to an instruction speed. It is also known, particularly by French patent application Nos. 82/22 146 and 82/22 147, how to stabilize the neutral or idling rotation speed, i.e., to reduce as much as possible the instabilities and pumpings of the engine, by acting on the angle of ignition advance.

However, none of these solutions makes it possible for it alone to nearly completely compensate for the significant variations of speed due to the starting or stopping of accessory devices such as an air conditioning system or similar system.

SUMMARY OF THE INVENTION

The invention aims at solving this problem, and for this purpose, it has as its principal object a process for regulating the rotation speed in neutral of an internal combustion engine with controlled ignition, during the starting and stopping of at least one accessory device that causes a sudden variation in the resisting torque. According to the invention signals for controlling the starting and stopping of the accessory device are detected, and the control of the accessory device is temporarily delayed by said control signals. During a first predetermined time period, an increase in the airflow of the engine in response to the detection of a signal controlling the starting of the accessory device is controlled. During a second predetermined time period, a decrease in the airflow in response to the detection of a signal for controlling the stopping of the accessory device is controlled. The starting and stopping of the accessory device is controlled approximately at the end of said predetermined periods.

According to a characteristic of the invention, there is also controlled a decrease in the airflow of the engine during a third predetermined time period and an increase in the airflow during a fourth predetermined time period immediately after said first and second time periods, respectively.

The invention also has as its object a device for using the process defined above. The device comprises an element for controlling the airflow of the engine, means for operating the control element, means for supplying the control means, and a programmed microcomputer which receives as inputs a signal representative of the operation in neutral or in gear of the engine and the signal for controlling the accessory device. The microcomputer is connected by one of its outputs to the supply means.

BRIEF DESCRIPTION OF THE DRAWINGS

Other characteristics and advantages of the invention will come out from the following description, given with reference to the accompanying drawings provided solely by way of example and in which.

DETAILED DESCRIPTION OF THE PREFERRED EMBODIMENT

Figure 1:
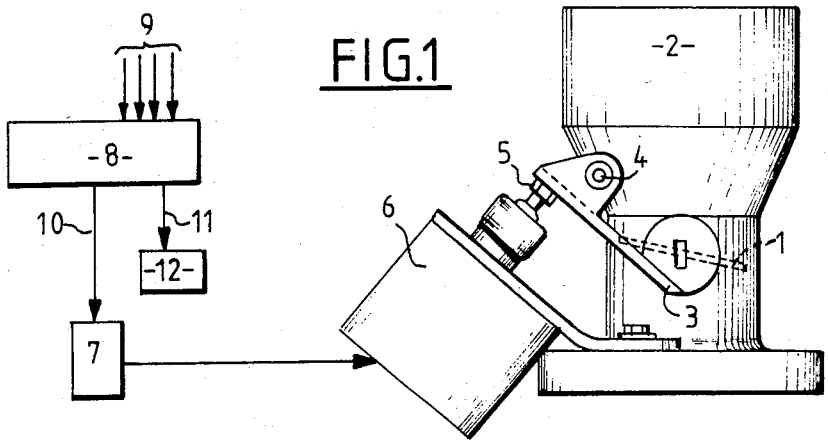
FIG. 1 is a diagram of a regulating device according to the invention.

With reference to FIG. 1, a butterfly valve 1, mounted in a case 2, is driven in rotation by a lever 3 on which an accelerator control is suspended at 4. The closing of the butterfly valve 1 is limited by an idling stop 5, mobile in translation under the action of an operating means 6 and against which the lever 3 is pulled by an elastic means (not shown).

The operating means 6 can be a back-geared motor, an electric, hydraulic pneumatic or similar jack, connected to a corresponding supply means 7.

The supply means 7 are themselves connected to a programmed microcomputer 8 having inputs 9 and outputs 10 and 11 which provides the control of the device.

The microcomputer 8 receives on its inputs 9 a certain number of signals comprising, among others, a signal representative of the operation in neutral or in gear of the engine which can be supplied, for example, by a raised foot contact, and the control signal for an accessory device with intermittent operation. It will be assumed below that the accessory device is the compressor of an air conditioning system and that the control signal is supplied by a thermostat (not shown). The microcomputer 8 controls the supply means 7 by its output 10 and a compressor 12 by its output 11.

Depending on the other functions that it fills, the microcomputer 8 can comprise other inputs and outputs. Among other things, it can be a microcomputer for controlling ignition, injection, or assuring these two functions as described, for example, in French patent application No. 82/13 996, which can be consulted.

The operation of the device of FIG. 1 will now be described with reference to the flowchart of FIG. 2:

Stage 20:

It is a test to determine whether the engine is operating in neutral or not. As shown above, this information is preferably represented by the state (closed or open) of a raise foot contact, but other parameters can be taken into account for example, the value of the pressure in the intake manifold compared with a threshold value.

If the response to this test is NO, one goes on to stage 21 and, if the response is YES, to stage 22.

Stages 21 and 22:

It is two identical tests to determine whether there is request for starting or stopping the compressor 12.

If the response to these two tests is NO, one goes directly to the continuation of the program which can concern the computation of other operating parameters of the engine such as, for example, the ignition advance or the injection time.

If the response to tests 21 and 22 is YES, one goes respectively to stages 23 and 24.

Stage 23:

It is a test to determine if there is a request for starting the compressor 12.

If the response is NO, one goes to stage 25 which is an order stopping the compressor 12;

If the response is YES, one goes on to stage 26 which is an order starting the compressor 12.

It is found that the sequence of stages 20, 21, 23, 25 and 26 does not involve any operation of the butterfly valve 1, which is normal since one is not then in neutral operating speed.

On the other hand, if the response to tests 20 and 22 is YES, one goes on to stage 24.

Stage 24:

It is, like stage 23, a test to determine whether there is a request for starting the compressor 12:

If the response is YES, one goes on to stage 27.

Stage 27:

The microcomputer 8 controls on its output 10 the partial opening of the butterfly valve 1, either during a predetermined time period $T_1$ if the operating means 6 is a direct current back-geared motor, or until a given angle of opening if the movement of the idling stop 5 is provided by a stepping motor. The butterfly valve 1 can also be opened during a given number of turns or fractions of turns, for example $N_1$ half-turns in the case where an angular reference signal is available at each half-turn of the motor.

Stage 28:

At the end of this predetermined period, the microcomputer 8 sends on its output 11 a signal for starting the compressor 12.

Stage 29:

The microcomputer 8 controls on its output 10 a partial closing of the butterfly valve 1 in comparison with the middle position that it occupies in neutral operation when the operating means 6 is not supplied. This partial closing can have an identical or different period from the opening which preceded it, and can last, for example, a time $T_2$.

If the response to stage 24 is NO, the reverse process of the preceding occurs:

Stage 30:

partial closing of butterfly valve 1 for a time $T_3$, for example;

Stage 31:

stopping of the compressor;

Stage 32:

partial opening of butterfly valve 1 for a time $T_4$, for example.

The opening and closing of the butterfly valve 1 are preferably expressed in time or angular value, which in both cases comes down to increasing or decreasing the airflow of the engine for a predetermined time period, because this method of control assures a very fine resolution. However, the various tasks filled by a microprocessor for management of the power plant being generally synchronized by an angular referencing signal Sy identifying the passage of each piston by the top dead center or the bottom dead center, it is also possible to control the opening and the closing of the butterfly valve in number of turns or fractions of turns of the engine. This solution has as drawbacks offering a less fine resolution and making the opening and closing time of the butterfly valve 1 dependent on the rotation speed in neutral of the engine.

Figure 3:
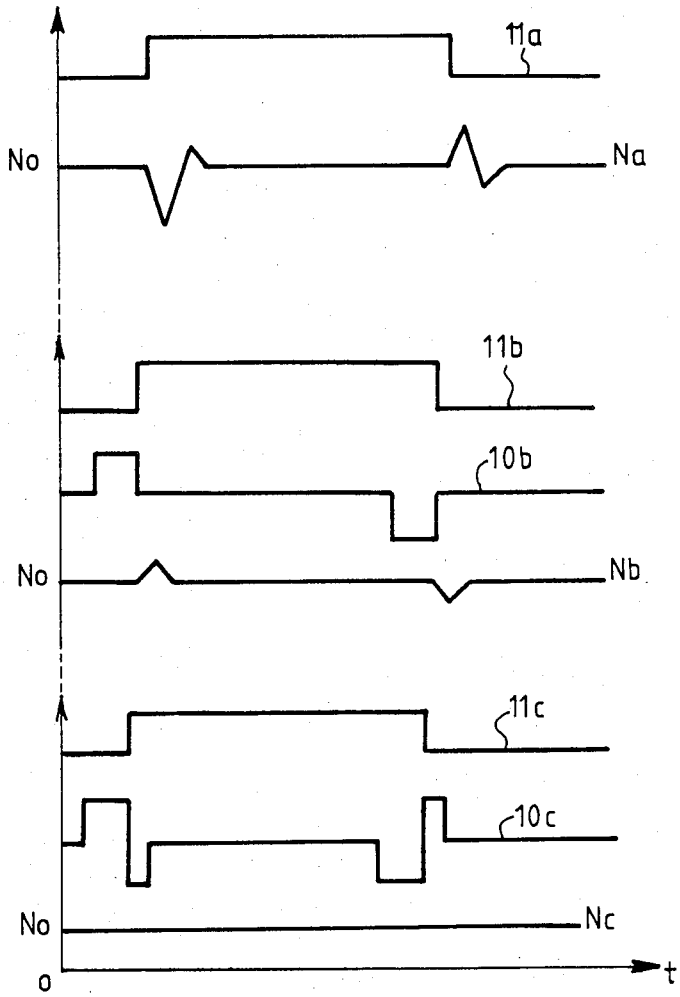
FIG. 3 is a timing diagram illustrating the effect on the engine speed of the starting and stopping of an air conditioning system, respectively in the cases where there is no regulation, where there is a partial regulation and where there is full regulation.

Referring now to the timing diagram of FIG. 3, a curve 11*a* represents the signal controlling the compressor 12, and a signal Na represents the idling speed of the engine in the absence of regulation. It is found that, during the starting of the compressor 12 corresponding to the passage of the signal 11*a* from the low level to the high level, there occurs a sharp drop in the rotation speed of the engine in comparison with the nominal idling speed No, followed by a greater increase above the nominal speed No, but of smaller amplitude than the drop which preceded it.

Likewise, the reverse phenomenon occurs during the stopping of the compressor.

The signals assigned the letter b illustrate the case of a regulation such as previously described except that the stages 29 and 32 are omitted, i.e., that an opening or closing of the butterfly valve 1 is not performed immediately after the opening and closing which preceded it. It is found that the opening of the butterfly valve 1 for a predetermined time period corresponding to the positive square wave of a signal 10*b*, followed by the starting of the compressor 12 on the descending front of this square wave, makes it possible to maintain a nearly constant engine speed Nb. This is due to the fact that there is a lag time between the initialization of the opening of the butterfly valve 1 and the effect of this opening on the engine speed, lag time on which the programmed time of opening of the butterfly valve 1 depends. However, as in the preceding case, a "rebound" effect occurs that is reflected by a temporary increase in speed shortly after the starting of the compressor 12. The same phenomena occur, in reverse, during the stopping of the compressor 12.

Figure 2:
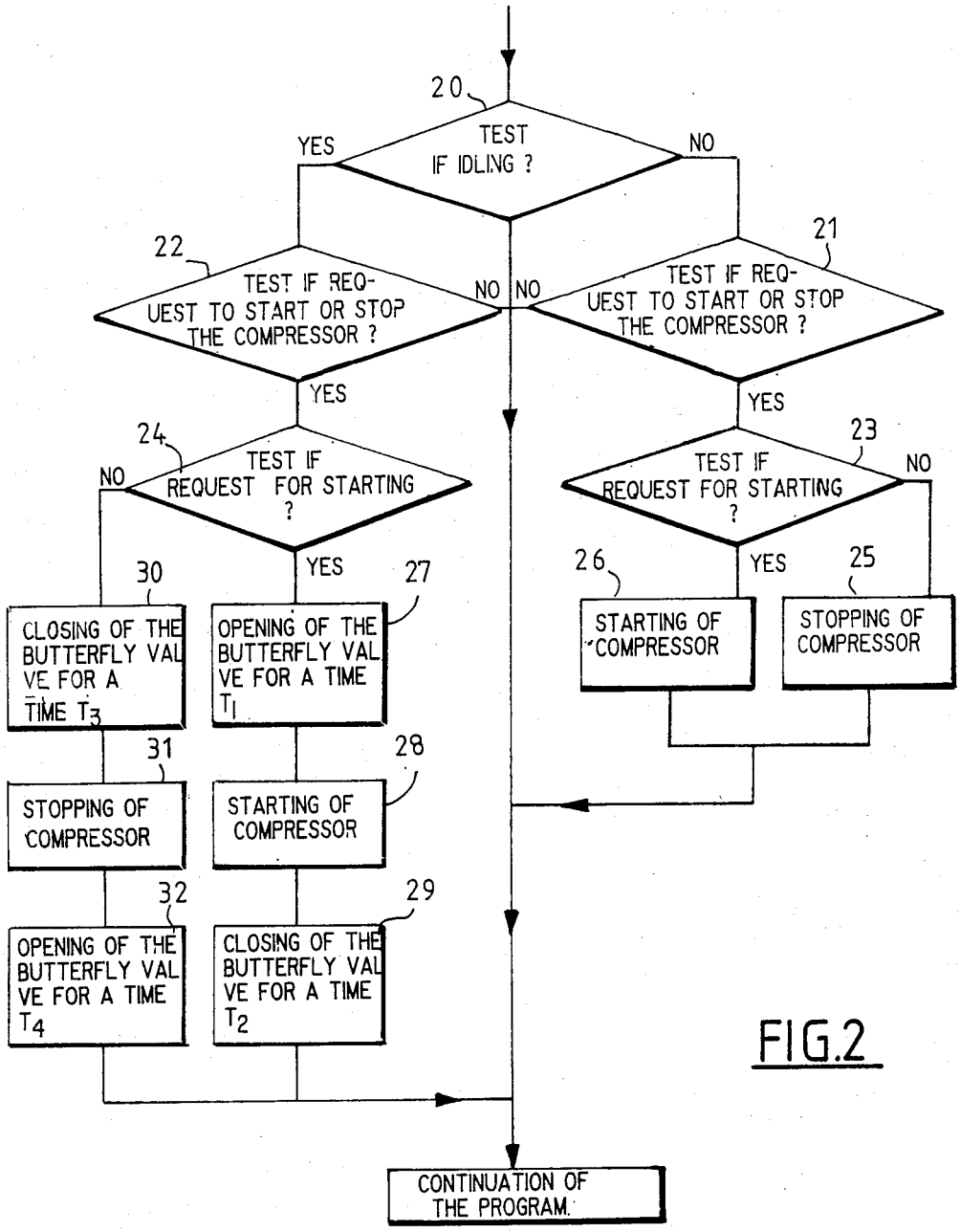
FIG. 2 is a flowchart of the operation of the microcomputer of FIG. 1 for using the process according to the invention.

Finally, the signals assigned the letter c correspond to the case of the regulation according to the flowchart of FIG. 2. It is found that the partial reclosing (small negative square wave of signal 10*c*) and the partial reopening (small positive square wave of signal 10*c*) of the butterfly valve 1 make it possible to compensate for the "rebound" effect following the starting and the stopping of the compressor 12, respectively.

As results from signal 10*c*, the partial reopening and reclosing of the butterfly valve 1 have shorter periods than the initial opening and closing. This is due to the fact that the amplitude of the "rebound" phenomenon is less than the variation of speed which results, in the absence of regulation, from the starting and stopping of the compressor 12 (see the signal Na). In addition, it will be noted that the two types of action are not equivalent: in one case, the control of the compressor 12 differs for a time equal, or approximately equal, to the period of the initial opening and closing of the butterfly valve 1, while, in the other case the "rebound" phenomenon is actually anticipated by causing the reclosing and reopening of the butterfly valve 1 at a selected instant in relation to that of the actual control of the compressor 12.

It will also be noted that, in the example described, there is a coincidence between the end of the initial action on the butterfly valve 1, the actual control of the compressor 12 and the beginning of the counteraction compensating for the "rebound". However, the invention is not limited to this embodiment, and a time lag can also be provided between the action and the counteraction, and the actual control of the compressor 12 also may not coincide with the end of the initial action of the butterfly valve 1.

We will now refer to the tables below which show the test results obtained without regulation (Tables 1a and 1b) and with full regulation (Tables 2a and 2b) and in which:

SPD ON=Lowest Recorded Engine Speed.

TIME ON=Time Necessary to Return to the Nominal Speed

SPD OFF=Highest Recorded Engine Speed

TIME OFF=Time Necessary to Return to the Nominal Speed

It is apparent from these tables that the regulation according to the invention makes possible a significant reduction in the variation of engine speed, mainly at low idling speeds.

On the other hand, this regulation makes possible a significant reduction of the time for returning to the nominal speed, especially in the case where the hydraulic converter of the automatic transmission is engaged.

It is important to note that the physiological sensations of the occupants of the vehicle are notably improved, indeed eliminated.

The same regulation can be used for an engagement or disengagement correction of the hydraulic converter of the automatic transmission, or any other accessory device whose starting and stopping causes a sudden variation of resisting torque. In addition, the lengths of the predetermined time periods for opening and closing the butterfly valve can be modulated as a function of the number of accessory devices which must be simultaneously started or stopped.

Of course, the invention is not limited to the embodiment described. Thus, for example, the increase or the decrease in the airflow of the engine can be provided by any suitable means other than a butterfly valve for example, by controlling the additional airflow in the the case of a carburetor equipped with a by-pass.

TABLE 1a (1) ENGINE AT IDLING WITH AUTOMATIC TRANSMISSION IN "NEUTRAL" POSITION.

| Nominal | Starting of the compressor | | Stopping of the compressor | |
|---|---|---|---|---|
| Speed | SPD ON | TIME ON | SPD OFF | TIME OFF |
| 850 RPM | 480 RPM | 5 SEC | 1090 RPM | 3 SEC |
| 950 RPM | 580 RPM | 2.1 SEC | 1330 RPM | 1.8 SEC |

TABLE 1b (2) ENGINE AT IDLING WITH AUTOMATIC TRANSMISSION IN "DRIVE" POSITION

| Nominal | Starting of the compressor | | Stopping of the compressor | |
|---|---|---|---|---|
| Speed | SPD ON | TIME ON | SPD OFF | TIME OFF |
| 850 RPM | 570 RPM | 8.7 SEC | 1090 RPM | 14.7 SEC |
| 950 RPM | 740 RPM | 3.6 SEC | 1260 RPM | 8.7 SEC |

TABLE 2a (3) ENGINE AT IDLING WITH AUTOMATIC TRANSMISSION IN "NEUTRAL" POSITION AT 40 DGS CTS.

| Nominal | Starting of the compressor | | Stopping of the compressor | |
|---|---|---|---|---|
| Speed | SPD ON | TIME ON | SPD OFF | TIME OFF |
| 850 RPM | 790 RPM | 0.5 SEC< | 960 RPM | 0.5 SEC< |
| 950 RPM | 920 RPM | " | 1000 RPM | " |

TABLE 2b (4) ENGINE AT IDLING WITH AUTOMATIC TRANSMISSION IN "DRIVE" POSITION AT 40 DGS CTS.

| Nominal | Starting of the compressor | | Stopping of the compressor | |
|---|---|---|---|---|
| Speed | SPD ON | TIME ON | SPD OFF | TIME OFF |
| 850 RPM | 800 RPM | " | 960 RPM | " |
| 950 RPM | 920 RPM | " | 1000 RPM | " |

What is claimed is:

1. A process for regulating the rotation speed in neutral of an internal combustion engine with controlled ignition during the starting and the stopping of at least one accessory device that causes a sudden variation of the resisting torque, said process comprising the steps of:

(a) testing to see whether the engine is idling;

(b) then, if the engine is idling, testing to see whether there is a request for starting or stopping an accessory device; and (c) then, (i) if there is a request for starting the accessory device, (A) effecting an increase in the air flow to the engine to a value above a reference level for a first predetermined time period ($T_1$) and (B) then, after the elapse of the first predetermined time period ($T_1$), starting the accessory device; and (ii) if there is a request for stopping the accessory device, (A) effecting a decrease in the airflow to the engine to a value below the reference level for a second predetermined time period ($T_3$), and (B) then, after the elapse of the second predetermined time period ($T_3$), stopping the accessory device.

2. A process as recited in claim 1 and further comprising the steps of:

(a) after the elapse of the first predetermined time period ($T_1$), effecting a decrease of the airflow to the engine to a value below the reference level for a third predetermined time period ($T_2$), and (b) after the elapse of the second predetermined time period ($T_3$), effecting an increase in the airflow to the engine to a value above the reference level for a fourth predetermined time period ($T_4$).

3. A process as recited in claim 2 wherein:

(a) the starting of the accessory device and the beginning of the third predetermined time period ($T_2$) coincide with the end of the first predetermined time period ($T_1$) and (b) the stopping of the accessory device and the beginning of the fourth predetermined time period ($T_4$) coincide with the end of the second predetermined time period ($T_3$).

* * * * *